United States Patent [19]

Tilse

[11] Patent Number: 4,842,545

[45] Date of Patent: Jun. 27, 1989

[54] CABLE CONNECTOR

[75] Inventor: Wilhelm Tilse, Birkenfeld, Fed. Rep. of Germany

[73] Assignee: Inovan GmbH & Co. KG, Birkenfeld, Fed. Rep. of Germany

[21] Appl. No.: 196,676

[22] Filed: May 20, 1988

[51] Int. Cl.[4] ..... H01R 4/24

[52] U.S. Cl. ..... 439/393

[58] Field of Search ..... 439/389–414, 439/417–419

[56] References Cited

U.S. PATENT DOCUMENTS

| | | | |
|---|---|---|---|
| 2,615,072 | 10/1952 | Gilbert | 439/393 |
| 2,878,373 | 3/1959 | Bramming | 439/393 |
| 3,492,629 | 1/1970 | Hirsch | 439/393 |

*Primary Examiner*—Joseph H. McGlynn

[57] ABSTRACT

In a connector for a flat conductor strip cable which consists of a two-part housing in which the cable is engaged by compression, one of the housing parts has a cavity with a cable support surface disposed at a first acute angle with respect to the direction in which the two housing parts are movable in engagement with one another and the other housing parts carry leaf spring contact members disposed at a second acute angle with respect to the same direction, which angle is smaller than the first angle and the leaf spring contact members have cutting edges adapted to cut through the insulation of the conductor strip cable and the slide onto the surface of the flat conductors upon compression of the housing parts thereby providing for firm contact of the leaf spring contact members with the flat conductors.

13 Claims, 4 Drawing Sheets

CABLE CONNECTOR

BACKGROUND OF THE INVENTION

The invention relates to a connector for flat conductor strip cables consisting of two-piece connector housings into which the conductor strips are inserted and in which contacts are established by engagement of the two pieces of the connector housings which include means for being locked in their engaged positions in which the desired contacts are established.

Two types of conductors strips are generally used, strips with round conductors and strips with flat conductors. Both types have their particular field of application: The flat conductor strip cable is generally utilized when easy and frequent bending of the cable in a direction normal to the plane of the flat strip is desired while rigidity or stiffness of bending in a direction normal to the first direction is desirable. Round conductors have the advantage of providing for a simple contacting capability for the conductors by way of cutting contacts which cut into the insulation in which the round conductors are embedded.

The use of such simple cutting contacts is not possible in connection with flat conductor strips; here the insulating layer must be removed at one side such that the flat conductors are exposed and resilient contact members are then placed onto the exposed flat conductors. Usually so-called ZIF plugs (Zero Insertion Force) are required since the flat conductor with the insulation material layer removed has only very little rigidity.

However, such ZIF plugs are relatively complicated, expensive and relatively unreliable devices. They are particularly unreliable because the resistances of that contact structures may be different at the time of establishing the contacts. They may also change substantially and uncontrollably with the age of the contacts. Flat conductor strips have therefore found use only in applications where the specific advantages mentioned earlier were overwhelming.

It is the object of the present invention to provide a connector adapted to make contact with the conductors of flat conductor strips as easily and as well as this is possible with round conductor cables, that is, without the removal of the insulating material at the ends of the flat conductor strips, and in a manner to provide reliable contacts over a long period of time.

SUMMARY OF THE INVENTION

In order to achieve this object a connector for a flat conductor strip cable, which connector consists of a two-part housing in which the cable is engaged, has one of the housing parts provided with a cavity and a cable support surface arranged at a predetermined first acute angle with respect to the direction in which the two housing parts are movable into engagement with one another and the other housing part carrying leaf spring contact members which are disposed at a second acute angle with respect to the direction of relative movement of the two housing parts which is smaller than the first angle and the leaf spring contact members have cutting edges adapted to cut through the insulation of the conductor strip cable and to slide onto the surface of the flat conductors upon compression of the housing parts, thereby providing for firm contact of the leaf spring contact members with the flat conductors when the two housing parts are engaged and locked together.

Contacts with other contact elements are established in this manner as follows:

The flat conductor strip cable is inserted into the connector housing up to a stop whereby the cable, finally guided by guide strips, is disposed on the support surface in the lower part of the connector housing. Subsequently the upper part of the connector housing is pressed onto the lower part such that the leaf spring contact members, which are arranged at an acute angle with respect to the support surface, and the conductor strip disposed thereon cut through the insulation material disposed on the flat conductors but then resiliently slide along the surface the flat conductors as a result of their acute angle position and engage the flat conductors in their end positions always with constant contact pressure. The procedure of establishing contact is therefore similar to that employed in connection with round conductor strip cables since the insulation material no longer needs to be removed in a separate work step but the contact members rather cut into the insulation to provide for a good galvanic contact while closing the connector housing. The cutting edges of the leaf spring contact members are preferably arranged in such a way that they are disposed normal to the flat conductor strip and at an acute angle so as to appropriately slice the insulating material and push it sidewardly. However the cutting edges may also be arranged parallel to the flat conductor strip in order to cut the insulating material and slide onto the conductors underneath the insulation material which surrounds the conductors like a hose. Depending on the insulation material and the kind of insulation, other cutting arrangements are possible such as cutting teeth formed from the leaf spring contact members or curved cutting edges. In any case it is essential that the cutting edges of the leaf spring contact members cut through the insulation material and then slide on the flat conductor material up to their end positions in which they abut the flat conductors with a predetermined constant engagement force. It is pointed out that in this manner of contacting not only the contact pressure is determined but also the position of the leaf spring contact members relative to the flat conductors of the flat conductor strip cable.

In order to insure cutting of the insulation material in a safe manner even if it is relatively rigid or hard while avoiding to cut into the flat conductors the arrangement is preferably such that the angle between the support surface and the direction of the contact forces in the area of contact of the leaf spring contact members with the flat conductor strip cable is steadily reduced during closing of the connector. In any case, the cutting edges of the leaf spring contact members are so arranged that they first meet the insulation material at a relatively large angle at which cutting of the insulation material is insured but that, upon initial cutting of the insulation material, the angle is reduced to such an acute angle relative to the flat conductor that cutting of the flat conductor material is safely avoided and the length of contact is relatively high.

In order to achieve these advantageous results it is important that the flat conductor strip cable is fixedly positioned in the connector housing and that also the angled position of the leaf spring contact members with their cutting edges relative to the cable is closely controlled during closing of the connector. The connector housing may be so designed that it is closed by pressing the two housing parts onto one another or by sliding them onto one another or that a combination movement is necessary for closing the housing wherein the housing parts are moved longitudinally while being pressed together. Such movement can be obtained if the housing upper part is hinged to the lower part by way of a swing arm such that, upon pivoting of the swing arm, the upper housing part is moved onto the lower housing part in a circular arc and is fixed in this position by the swing arm.

It has already been mentioned that the flat conductor strip cable is inserted into the connector up to a stop. This stop does not only insure that a predetermined length of cable is inserted into the connector but it also prevents the cable from sliding away when being cut by the leaf spring contacts. A cable engagement structure which securely holds the cable in position and which is effective in advance of such sliding forces, that is, an arrangement which, upon closing of the connector, provides for engagement of the cable before the leaf spring contacts cut into the cable insulation, also serves such purpose.

The leaf spring contact members may be adapted to be current conducting contactors, that is, they may have soldering pins, for example, which project from the connector housing. They may be formed into the connector housing, for example, in such a manner that they penetrate the housing top part and form the soldering pins projecting upwardly through the housing top part or they may be L-shaped, that is, bent side- or backwardly so as to extend parallel to the housing wall through which they project. It is also possible that the free ends of the spring leaf contact members are adapted to make contact with also other types of conductors, for example, that they have cutting contacts for engagement with the conductors of a round conductor strip cable or that a connector has already conductors associated therewith. It is also possible to provide a connector which provides for optical coupling means.

SHORT DESCRIPTION OF THE DRAWINGS

DESCRIPTION OF THE PREFERRED EMBODIMENTS

Figure 1:
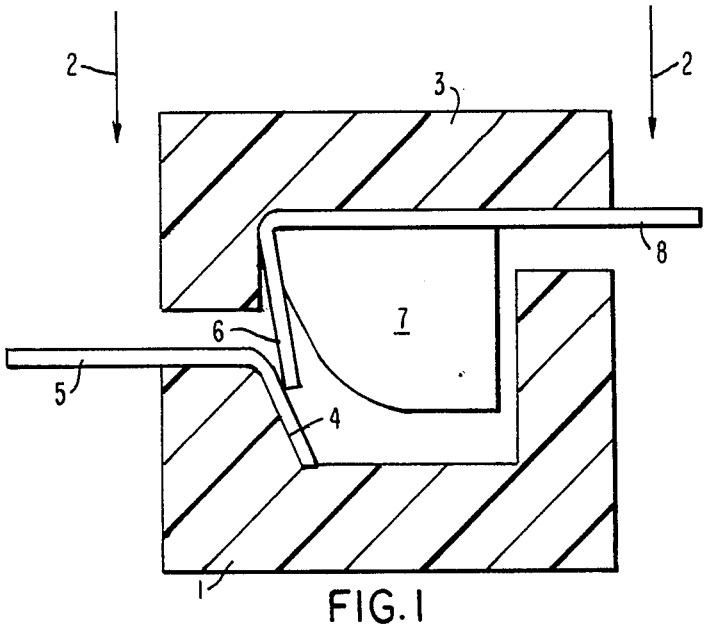
FIG. 1 shows an embodiment of the connector with conductors extending through the housing side.

As shown in FIG. 1 the connector housing consists of a lower housing part 1 and an upper housing part 3 which may be pressed onto the lower housing part in the direction of arrows 2 for engagement therewith. The lower housing part 1 has a support surface 4 formed therein on which a flat conductor strip cable 5 is disposed. Within the upper housing part 3 there is disposed a leaf spring contact member 6 which is firmly retained therein by means of a pressure member 7. As shown in FIG. 1 the leaf spring contact member 6 is L-shaped and extends through the connector housing so as to project therefrom sidewardly. In the arrangement as shown in FIG. 2 the leaf spring contact member 6 is formed into the upper housing part 3 and projects therefrom upwardly to form soldering connections 8 on top of the upper housing part 3.

Figure 2:
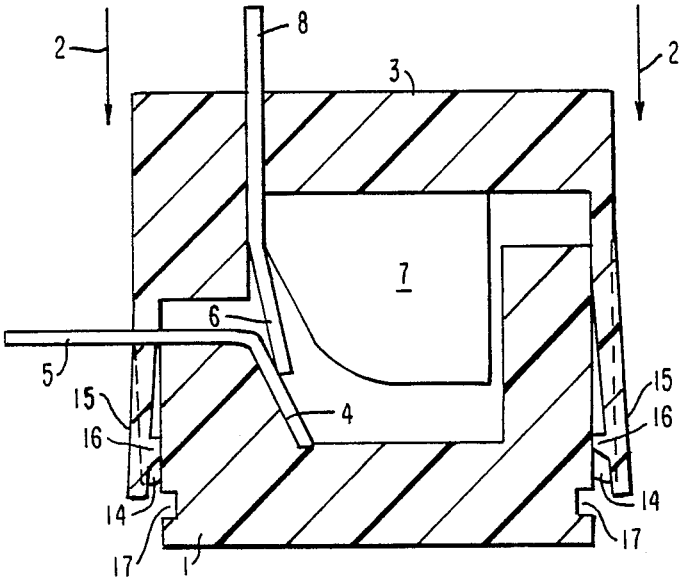
FIG. 2 shows an embodiment of the connector with conductors extending through the housing top.

FIGS. 1 and 2 shows the connector according to the invention before the two housing parts are pressed together into engagement with one another.

FIG. 2 also shows a slide guide structure 14 and engagement arms 15 projecting from the upper housing part and having projections 16 for reception in openings 17 in the lower housing part.

Figure 3:
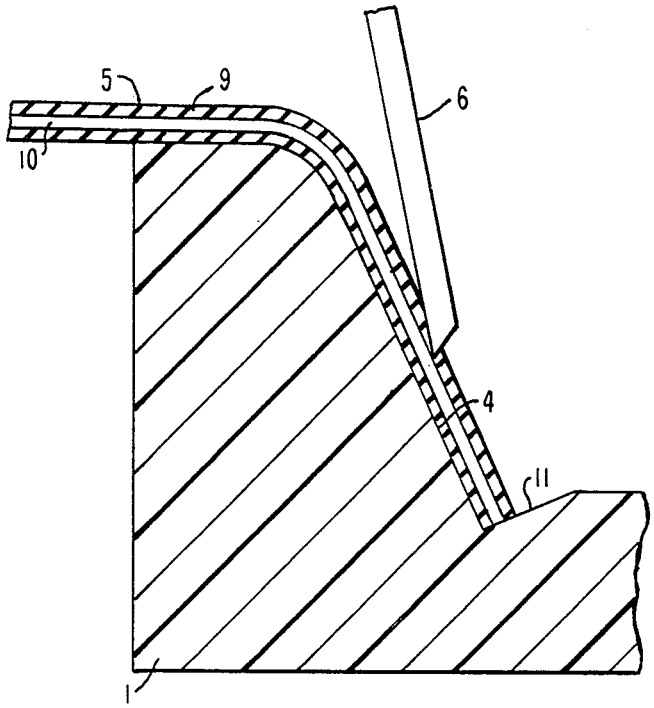
FIG. 3 shows the insulating material cutting procedure at the beginning thereof.

FIG. 3 illustrates the beginning of the connecting process where the leaf spring contact member 6 starts to cut into the insulation 9 of the flat conductor strip cable which has its end disposed in abutment with the stop surface 11 of the lower housing part 1. After piercing the insulation layer 9 the leaf spring contact member 6 slides along the flat conductor 10 without piercing the flat conductor because of the acute angular orientation of the leaf spring contact member 6 relative to the flat conductor strip 10 until the leaf spring contact member 6 has reached the end position shown in FIG. 4.

Figure 4:
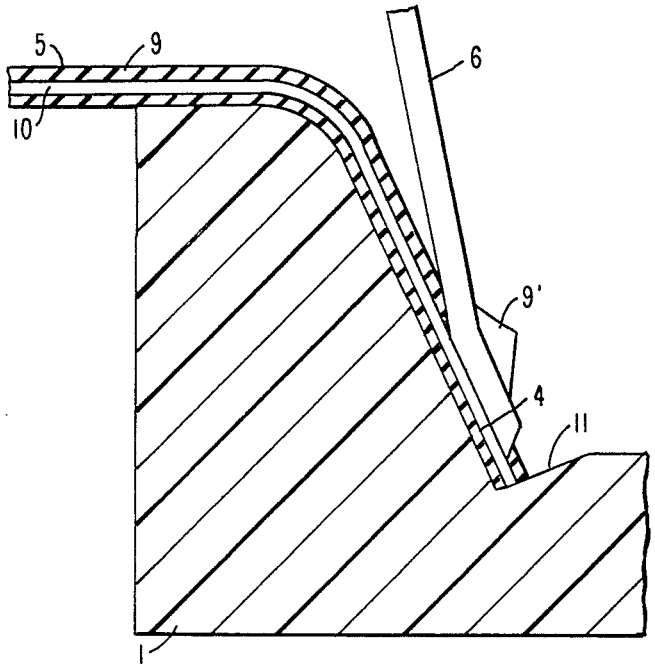
FIG. 4 shows the cutting procedure at the end.
Figure 5:
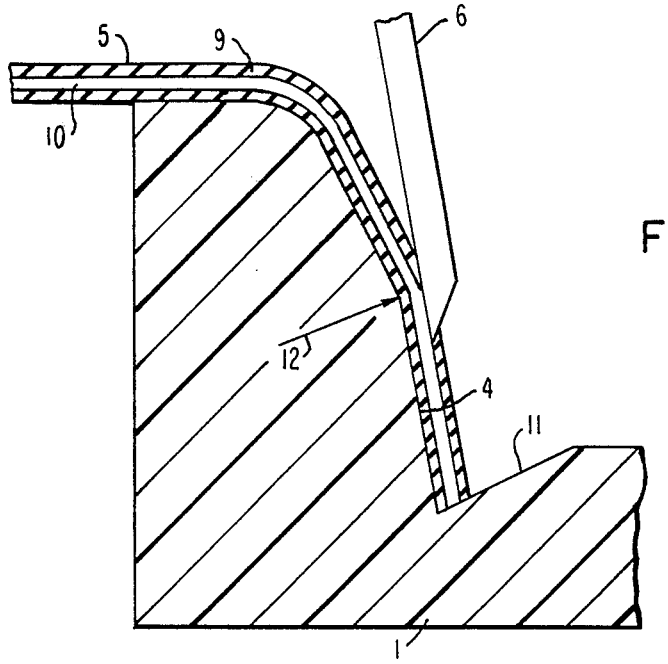
FIGS. 5 and 6 are similar to FIGS. 3 and 4 but with a connector with a slightly different support surface.
Figure 6:
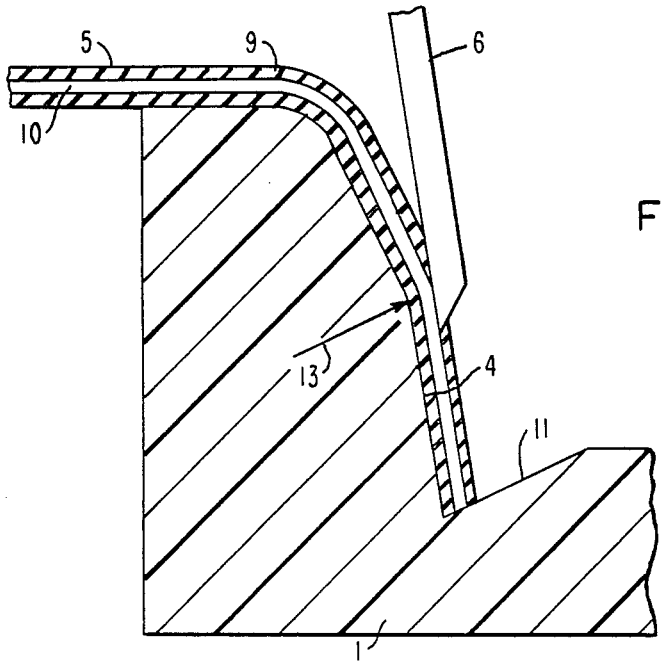

In this end position the leaf spring contact member 6 engages the flat conductor 10 resiliently with a predetermined contact pressure. The insulation material above the flat conductor 10 is forced to the side as shown at 9' in FIG. 4. FIGS. 5 and 6 show the beginning of the insulation material piercing process just like FIG. 3 but with a support surface 4 which is slightly angled in the area where the contact member cutting edges meet the flat conductor so that an edge 12 or a corresponding curved area 13 is formed. This insures that the cutting edges of the leaf spring contact members meet the insulation material 9 first at a somewhat more obtuse angle to insure their cutting into the insulation material 9 but that, after piercing of the insulation material 9, the leaf spring contact members are disposed at a very acute angle with respect to the flat conductor surface so that they will not cut into the flat conductor material but will slide along on the surface thereof.

Figure 7:
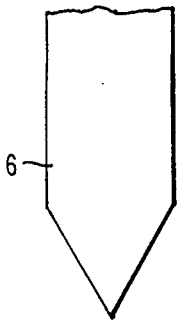
FIGS. 7, 8 and 9 show different leaf spring cutting edges.
Figure 8:
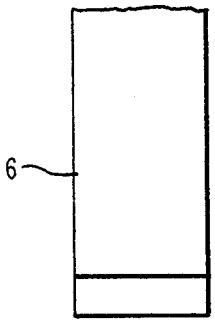
Figure 9:
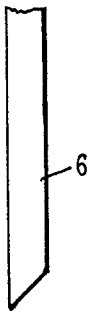

FIG. 7 shows an embodiment of the cutting edge of the leaf spring contact member 6. With such an arrowpoint like arrangement the cutting edge which extends essentially normal to the support plane cuts into the insulation material 9 of the flat conductor strip cable 5 in a plow-like fashion and, upon further sliding along on the conductor strip 10, pushes the insulation material 9 to the side as this is shown in FIG. 4 at 9'. With the cutting edge arrangement as shown in FIGS. 8 and 9 the cutting edge of the leaf spring contact member 6 pierces the insulation material but then slides along on the flat conductor surface underneath the insulation material 9 and resiliently engages the flat conductor strip underneath the insulation material. FIG. 9 shows the cutting edge of the contacting member 6 of FIG. 8 from the side.

It is noted that the acute angle between the leaf spring contact member 6 and the support surface 4 and the direction of movement of the upper housing part toward the lower housing part at the point of engagement of the spring contact member with the cable is preferably between 30° and 50°.

However the spring contact member is somewhat angled with regard to the direction of movement so that the acute angle between the spring contact member and the support member is between 10° and 30°.

Figure 10:
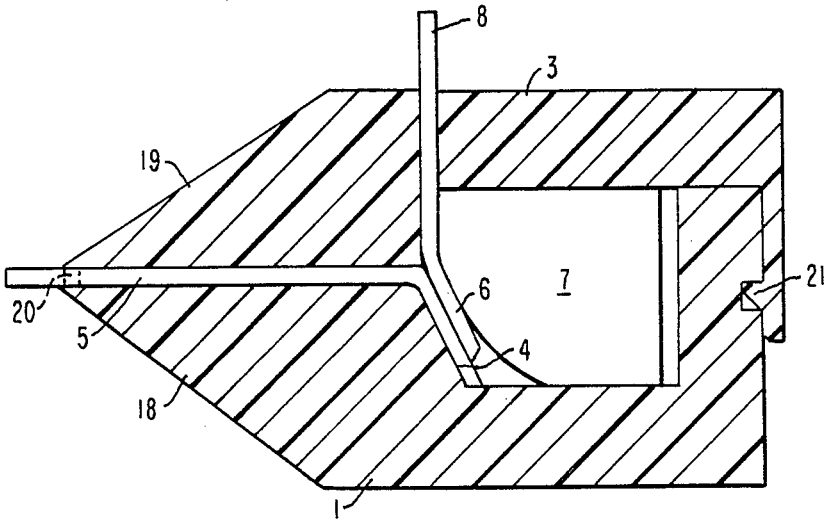
FIG. 10 shows a connector with hinged housing parts.

FIG. 10 shows an arrangement in which the lower and upper housing parts 1 and 3 are provided with swing arms 18 and 19 which are hinged together at 20 and which are engaged in the closed position by engagement means 21.

What is claimed is:

1. A connector for a flat conductor strip cable comprising a two-part housing adapted to receive a portion of said cable and to be engaged in said housing by compression of the two parts of said housing, the housing parts having engagement means for retaining said parts in compression with one another, said housing parts further including means for controlling the movement of the housing parts together for compression in a predetermined direction, one of said housing parts having a support surface disposed at a first acute angle with respect to said predetermined direction of relative movement of said housing parts, and the other housing parts carrying leaf spring contact members projecting therefrom toward said support surface and disposed at a second acute angle with respect to the predetermined direction of relative movement of said housing parts which is smaller than said first acute angle, said leaf spring contact members having cutting edges formed at their front ends adapted to cut through the insulation material of said conductor strip cable and slide onto the surface of said flat conductors upon compression of said housing parts thereby to provide for firm contact of said leaf spring contact members with said flat conductors.

2. A connector according to claim 1, wherein the angle between the support surface and the predetermined direction of relative movement between said housing parts is between 30° and 50°.

3. A connector according to claim 2, wherein said support surface is somewhat angled in the area where the contact members' cutting edges meet the flat conductor strip cable such that after cutting the insulation material the angle between the flat conductor and the leaf spring contact member is reduced.

4. A connector according to claim 1, wherein the angle between the leaf spring contact members and the support surface is between 10° and 30°.

5. A connector according to claim 1, wherein said leaf spring contact member is pointed at its front end.

6. A connector according to claim 1, wherein a stop surface is provided at the end of the support surface for positioning and locating the cable in the connector.

7. A connector according to claim 1, wherein said one housing part of the connector has a cavity formed therein with one of the cavity walls being formed by said support surface and the other housing part of said connector has arranged adjacent the insert opening for the cable a pressure bar providing a curved surface backing the leaf spring contact members and adapted to be received in the cavity of said one housing part.

8. A connector according to claim 1, wherein the leaf spring contact members extend through the other housing part so as to project therefrom in said predetermined direction of relative movement.

9. A connector according to claim 1, wherein said leaf spring contact members are L-shaped and project from the other housing part in the direction in which the flat conductor strip cable is inserted into the connector.

10. A connector according to claim 1, wherein pressure members are disposed adjacent said leaf spring contact members.

11. A connector according to claim 10, wherein said pressure members are formed by a single pressure bar.

12. A connector according to claim 1, wherein the two housing parts are joined by hinges.

13. A connector according to claim 12, wherein said hinges are arranged at the cable insert end of said connector.

* * * * *